US006269651B1

(12) United States Patent
Price

(10) Patent No.: US 6,269,651 B1
(45) Date of Patent: Aug. 7, 2001

(54) COOLING APPARATUS

(75) Inventor: Alan Price, Dublin (IE)

(73) Assignee: Scotsway Limited, County Dublin (IE)

( * ) Notice: Subject to any disclaimer, the term of this patent is extended or adjusted under 35 U.S.C. 154(b) by 0 days.

(21) Appl. No.: 09/429,435

(22) Filed: Oct. 28, 1999

(51) Int. Cl.[7] ..... A47F 3/04

(52) U.S. Cl. ..... 62/255; 62/384; 62/420; 62/459

(58) Field of Search ..... 62/246, 420, 459, 62/463, 388, 384, 249, 255

(56) References Cited

U.S. PATENT DOCUMENTS

| | | | | |
|---|---|---|---|---|
| 1,687,440 | | 10/1928 | Gloekler . | |
| 1,967,542 | * | 7/1934 | Simmons et al. | 62/384 |
| 1,997,936 | | 4/1935 | Kiesel, Jr. . | |
| 2,143,213 | * | 1/1939 | Reichle | 62/388 |
| 2,169,511 | * | 8/1939 | Bolen | 62/388 |
| 2,327,520 | * | 8/1943 | Hagstrom et al. | 62/388 |
| 2,786,339 | * | 3/1957 | Roberts | 62/388 |
| 3,605,433 | * | 9/1971 | Strathaus | 62/384 |
| 3,971,231 | * | 7/1976 | Derry | 62/388 |
| 4,628,697 | * | 12/1986 | Bruck et al. | 62/255 |
| 5,046,332 | * | 9/1991 | Herrmann et al. | 62/388 |

FOREIGN PATENT DOCUMENTS 609 962 8/1994 (EP) .

* cited by examiner

*Primary Examiner*—William E. Tapolcal
(74) *Attorney, Agent, or Firm*—Ohlandt, Greeley, Ruggiero & Perle, LLP

(57) ABSTRACT

A cooling apparatus, such as a consumer display unit 400, comprises a covered tray 403 or other compartment for accommodating consumer product to be kept cool, and a housing 420 for accommodating a replaceable charge of dry ice out of contact with the product. A tubular element 421 communicates between the covered tray and the housing 420 to allow cold air and carbon dioxide to flow from the dry ice to the product.

8 Claims, 17 Drawing Sheets

Fig. 11
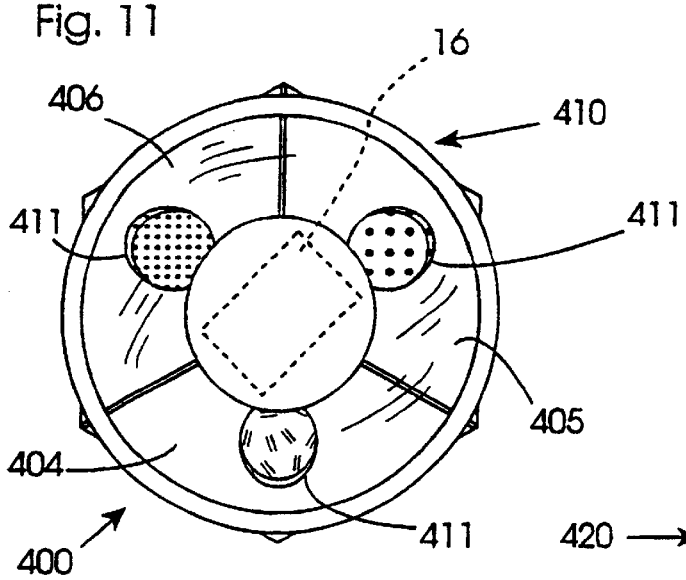
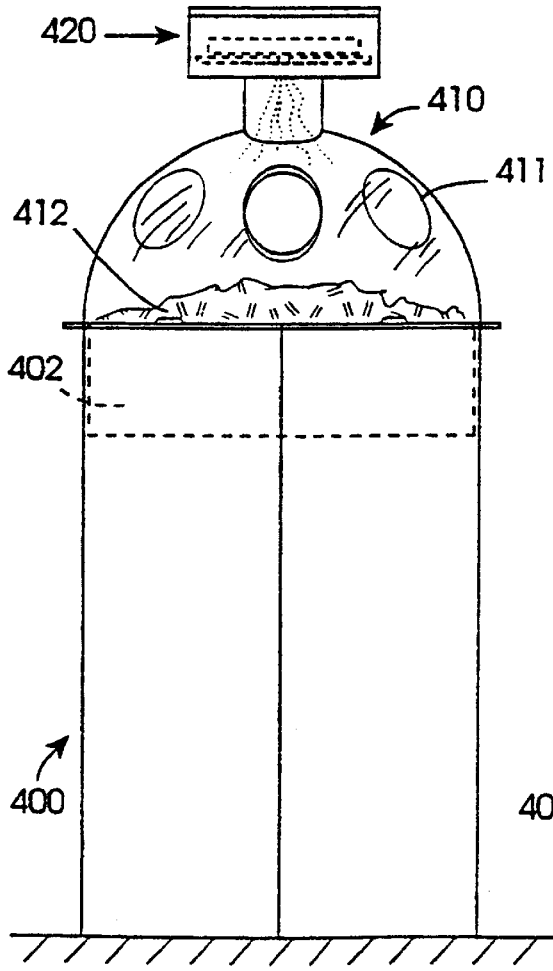
Fig. 9
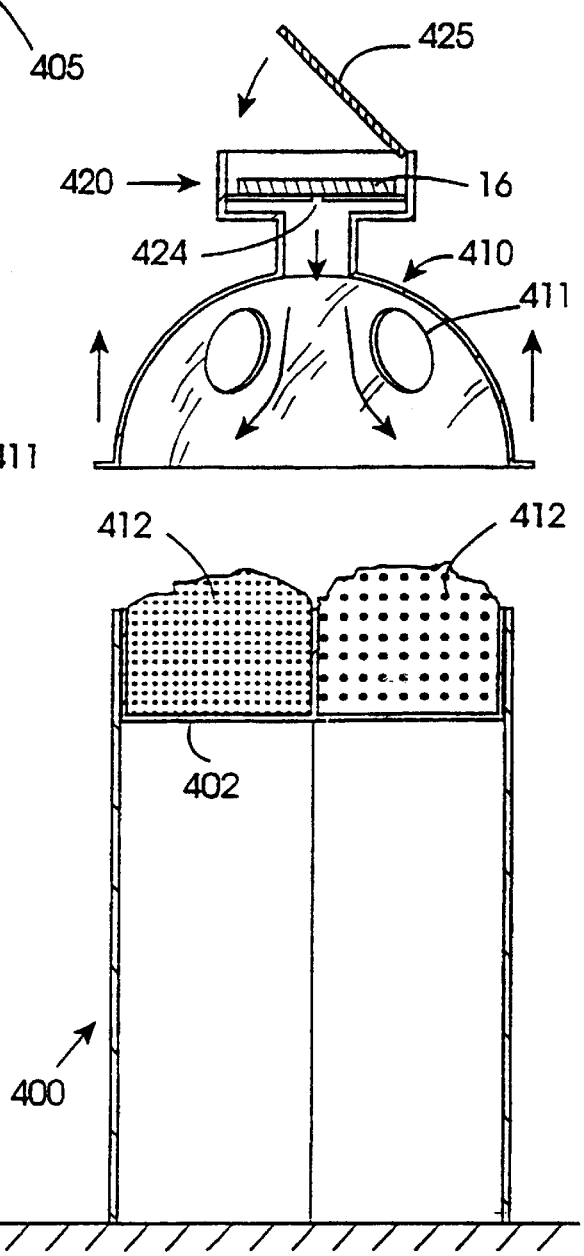
Fig. 10

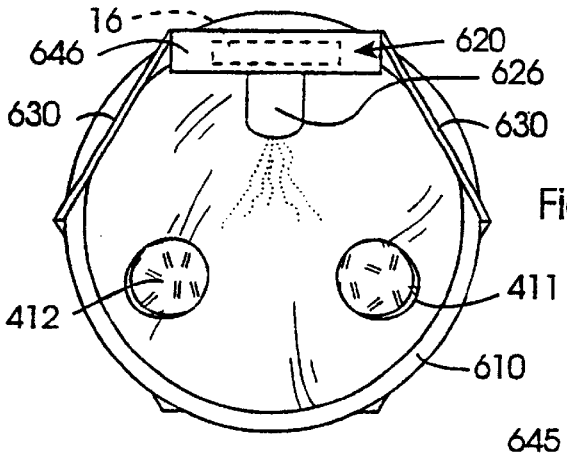
Fig. 23
Fig.21
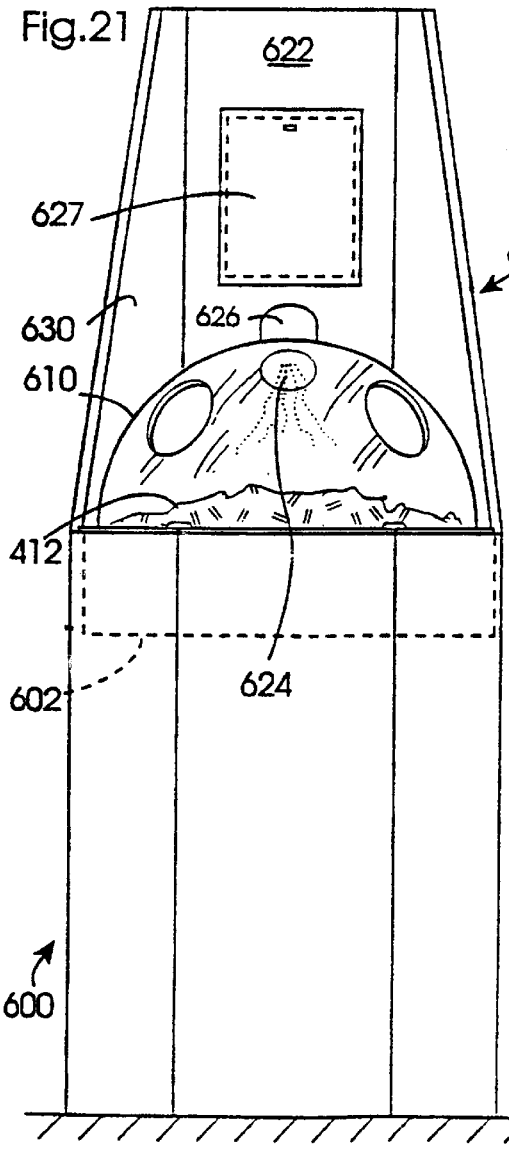
Fig. 22
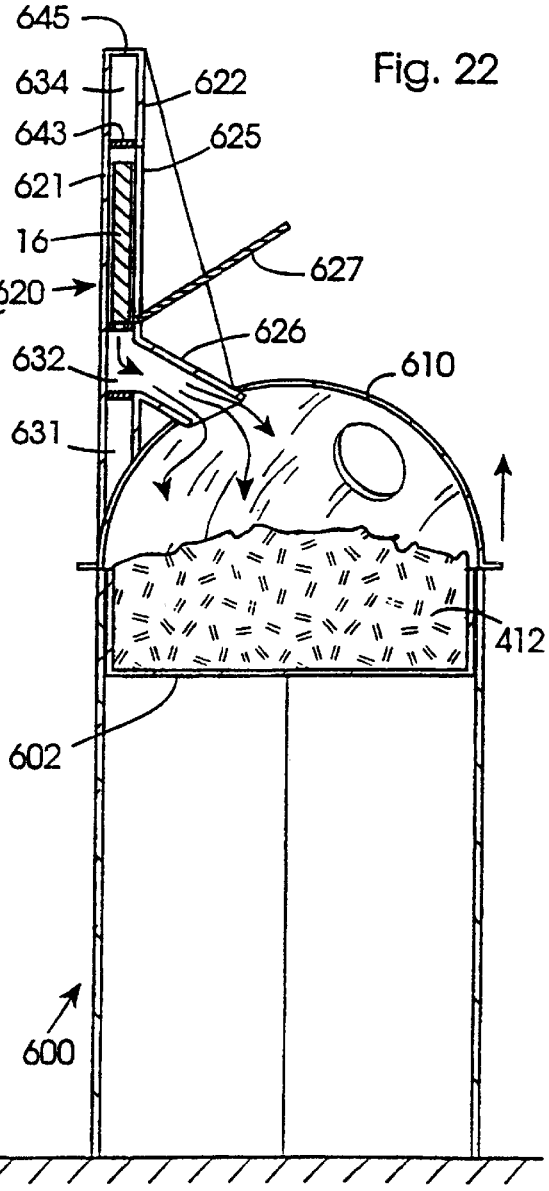

COOLING APPARATUS

This invention relates to a cooling apparatus, in particular, but not limited to, a display device.

It has long been realised that merchandising products through free-standing display units leads to much greater turnover in products. This has proven to be impractical with products that need to be kept cool, such as butter and other dairy products, as they had to be displayed in electrically powered fridges and the necessary cables and powerpoints for the supply of power to these fridges presents the shopkeeper or supermarket owner with logistical problems.

It is an object of the present invention to overcome these problems.

The invention, therefore, provides a cooling apparatus comprising first means for accommodating at least one consumer product to be kept cool, second means for accommodating a replaceable charge of solid coolant out of contact with the product, and communication means between the first and second accommodating means to allow cold gas to flow from the solid coolant to the product.

Embodiments of the invention will now be described, by way of example, with reference to the accompanying drawings, in which:

FIG. 9 is a front elevation of the unit of FIG. 8 of the drawings;

FIG. 10 is a cutaway view of the unit of FIG. 8 of the drawings showing the cover detached therefrom;

FIG. 11 is a plan view of the unit of FIG. 8 of the drawings;

FIG. 21 is a front elevation of the unit of FIG. 20 of the drawings;

FIG. 22 is a cutaway and side elevation of the cabinet of FIG. 20 of the drawings;

FIG. 23 is a plan view of the cabinet of FIG. 20 of the drawings;

Figures 1, 3:
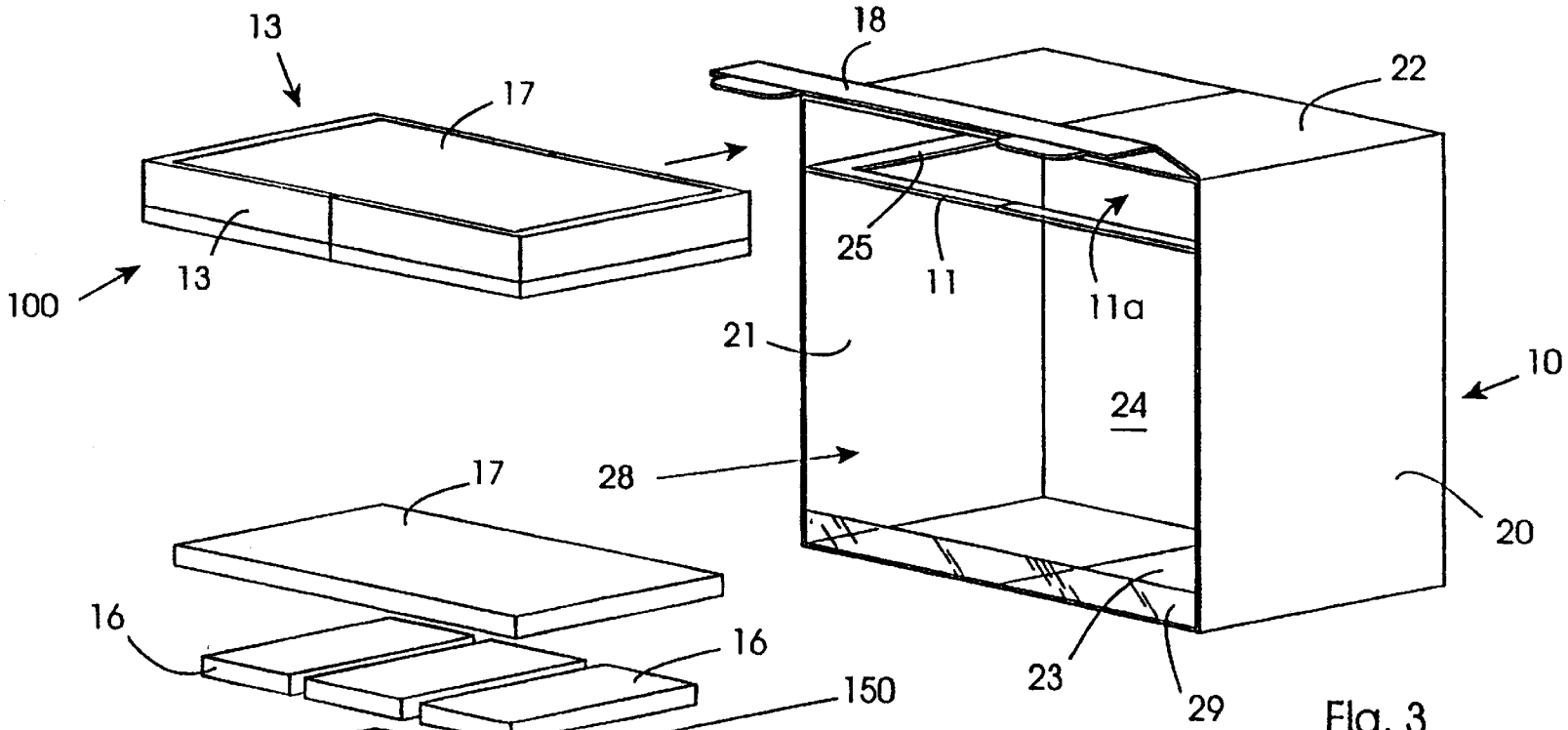
FIG. 1 is an exploded view of a first housing for solid coolant.
FIG. 3 is a perspective view of a first embodiment of a display unit according to the invention.
Figure 4:
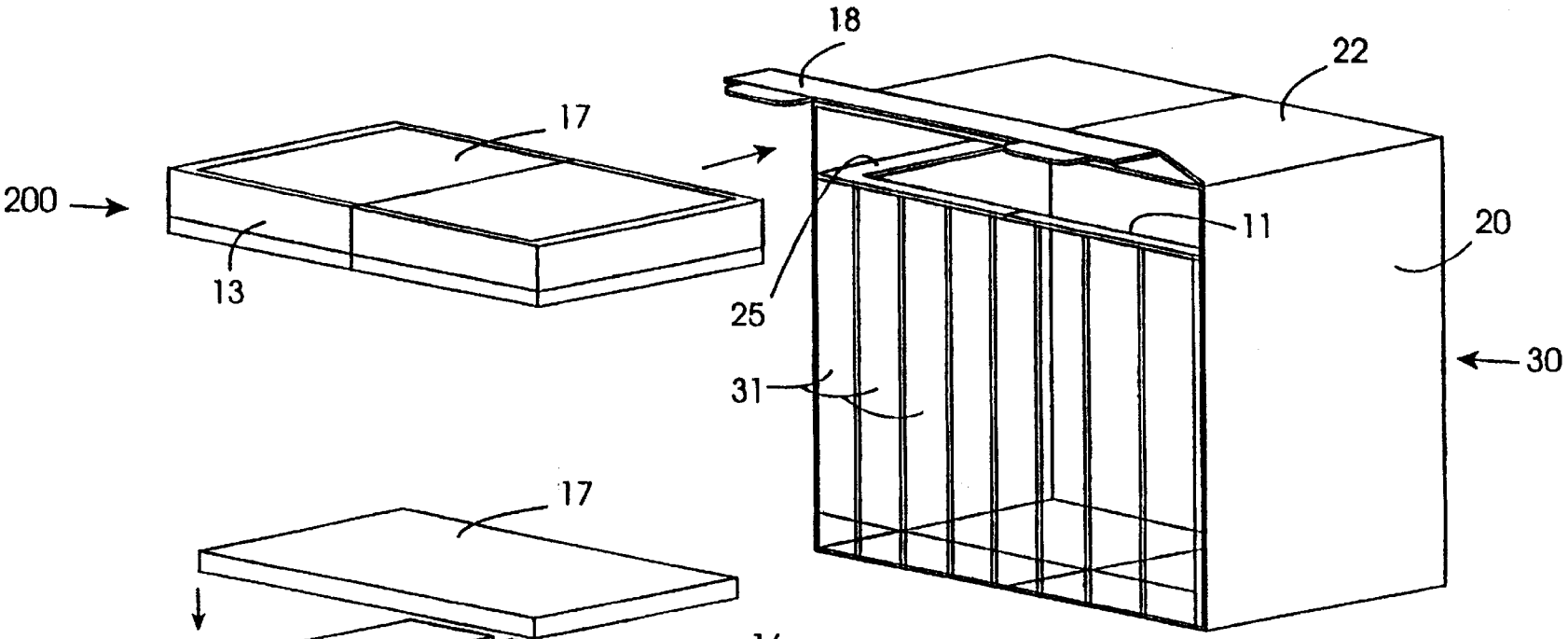
FIG. 4 is a perspective view of a second embodiment of a display unit according to the invention.

Referring now to the drawings and in particular to FIG. 1, a housing 100 for solid coolant, for use in the embodiments of the invention shown in FIGS. 3 and 4, comprises a thermally insulating polystyrene open-bottomed tray 13 of substantially rectangular shape and having an internally disposed step or ledge 14. A grid shaped element 15 of a plastics material and having a plurality of apertures 150 therein rests on the ledge 14 and forms the base of the housing 100. An insulating polystyrene cover 17, forming the top of the housing 100, is also provided which, when in situ, sits within the tray 13, on top of solid coolant placed on the element 15.

Figure 2:
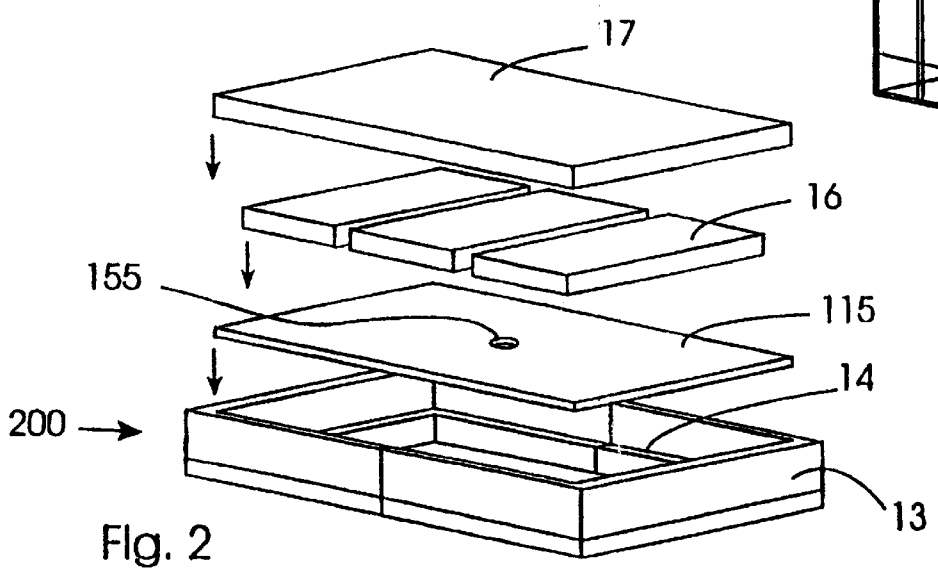
FIG. 2 is an exploded view of a second housing for solid coolant.

With reference now to FIG. 2 of the drawings, there is shown an alternative housing 200 for solid coolant. The device 200, like the device 100 has the same type of tray 13 with ledge 14 and cover 17. However, instead of employing a grid shaped element 15, a plastics plate-like element 115 is provided which rests on the ledge 14. The element 115 has a single circular aperture 155 located substantially centrally of the element 115. The aperture 155 has a diameter $\phi$ of between 5 mm and 40 mm with a preferred diameter $\phi$ of between 10 mm and 30 mm and most preferably between 10 mm and 15 mm.

In use, one or more flat packs 16 of a solid coolant such as dry ice are placed into the tray 13 of either housing 100 or 200. The pack or packs 16 rest on the element 15 or 115 as the case may be. More specifically, in the case of a housing 200 which has an aperture 155 having a diameter $\phi$ of say 15 mm, one or more packs 16 having a combined initial weight of approximately 2 kg may be used. In the case of a housing 200 having an aperture 155 with a diameter $\phi$ of 40 mm, the initial weight of the pack(s) 16 is approximately 4.5 kg. In the case of a housing 200 with an aperture 155 having a diameter $\phi$ of 30 mm the initial weight of the packs is approximately 3.5 kg.

Suitable packs 16 of dry ice are manufactured by Hydrogas Limited of South Humberside, UK, under the trade name HYDROGAS. Each pack 16 is perforated to allow $CO_2$ gas to evaporate as the dry ice sublimes. Preferably, the external surface of each of the packs 16 is silvered.

With particular reference to FIG. 3 of the drawings, there is shown a first embodiment of cooling apparatus according to the invention, in the form of a display unit 10.

The unit 10 comprises a rectangularly shaped container having side walls 20, 21, a top wall 22, a bottom wall 23 and a rear wall 24. A ledge 25 is provided around the side walls 20, 21 and the rear wall 24, and a support 11 provides a continuation of the ledge across the front of the container. The ledge 25 and the support 11 are located relative to the top wall 22 so as to provide an opening 11*a* into which a housing 100 (or 200) is inserted. Below the opening 11*a* is provided a large compartment 28 into which product suitable for maintaining at a temperature in the region of from 1° C. to 7° C., preferably approximately 5° C. is to be temporarily housed. Such product includes, but is not limited to, dairy products such as butter, cheese, milk and the like; chocolate and other confectionery; and drinks in bottles or cans including water, carbonated drinks, beer, lager, wine and the like.

If desired a clear perspex wall 29 about 50 mm in height may be provided at the front lower end of the compartment 28 to prevent product from accidentally falling from the unit 10.

Hinged to the top wall 22 is a flap 18 which serves to close the opening 11*a* when the housing 100 or 200 is in situ.

With particular reference to FIG. 4 of the drawings, there is shown a second embodiment of a display unit 30 according to the invention which enjoys all the features of the unit 10 and functions in a similar fashion. However, unlike the unit 10, the unit 30 is provided with a plurality of dependant clear plastics strips 31 which are attached to the support 11 and which, as is well known, provide an insulation curtain for the compartment 28.

It will be understood that, in the embodiments of FIGS. 3 and 4, the apertures 150 in the grid 15, or the single aperture 155 in the element 115, provide communication between the housing 100 or 200 and the compartment 28 to allow cold gas (i.e. air and/or carbon dioxide) to flow downwardly from the solid coolant in the housing 100 or 200 to the product in the compartment 28.

Depending on the volume of the compartment 28, the aperture 155 may vary in size. An example of the relationship between the weight of ice, the dimensions and volume of the compartment 28 and the size of the aperture 155 of the element 115 is provided below.

CHART 1

| TYPE | Dimensions of compartment 28 (w × h × d (mm)) | Volume of compartment 28 ($cm^3$) | Initial wt of ice (kg) | Ø of the aperture 155 (mm) |
|---|---|---|---|---|
| A | 320 × 340 × 300 | 32.64 | 2 | 15 |
| B | 480 × 340 × 300 | 48.96 | 3.5 | 30 |
| C | 600 × 340 × 300 | 61.2 | 4.5 | 40 |

When the solid coolant housing 100 or 200 is to be used, fresh packs 16 of dry ice are placed on the grid 15 or 115 and the cover 17 placed over them. The housing 100 or 200 is then placed into the opening 11*a* of the unit 10 or 30 and the cover 18 is closed. Product placed in the compartment 28 and housed in the unit 10 or 30 has been found to remain at a temperature of approximately 5° C. over an eighteen hour period.

With particular reference to Graph 1, it will be observed that in the case of the use of the unit 30 having the data given above in chart 1, and in particular Type A, the compartment 28 had a temperature of 5° C. over an eighteen hour period. Graph 1 represents test conditions having the following criteria viz.

i. the ambient temperature was maintained at 21° C. throughout the period of the test;

ii. the unit 10 contained approximately 7.5 kg of product (comprising varying quantities of margarine, cooking oil, yoghurt and water;

iii. prior to loading, 5 kg of the product had been stored at a temperature of approximately 8° C. and 2.5 kg stored at approximately 5° C.

Temperatures were recorded at fifteen minute intervals and bearing in mind that the initial temperature of the unit 30 was close to ambient, a temperature of 5° C. was achieved within approximately forty-five minutes following the loading of the dry ice. The air temperature within the unit 30 was found to be as shown in Graph 1 over the relevant time period. At the end of the eighteen hour period, the product remained below 5° C. for approximately three hours. It will be appreciated that at the end of the eighteen hour period if a fresh charge of dry ice is loaded, the temperature will be maintained at or below 5° C.

At the end of the eighteen hour period, if it is desired to continue to use the unit 30 (or 10), the housing 100 (or 200) is removed, the lid 17 lifted and fresh ice packs 16 placed therein. The recharged housing 200 (or 100) is placed in the aperture 11*a* as before.

Figure 5:
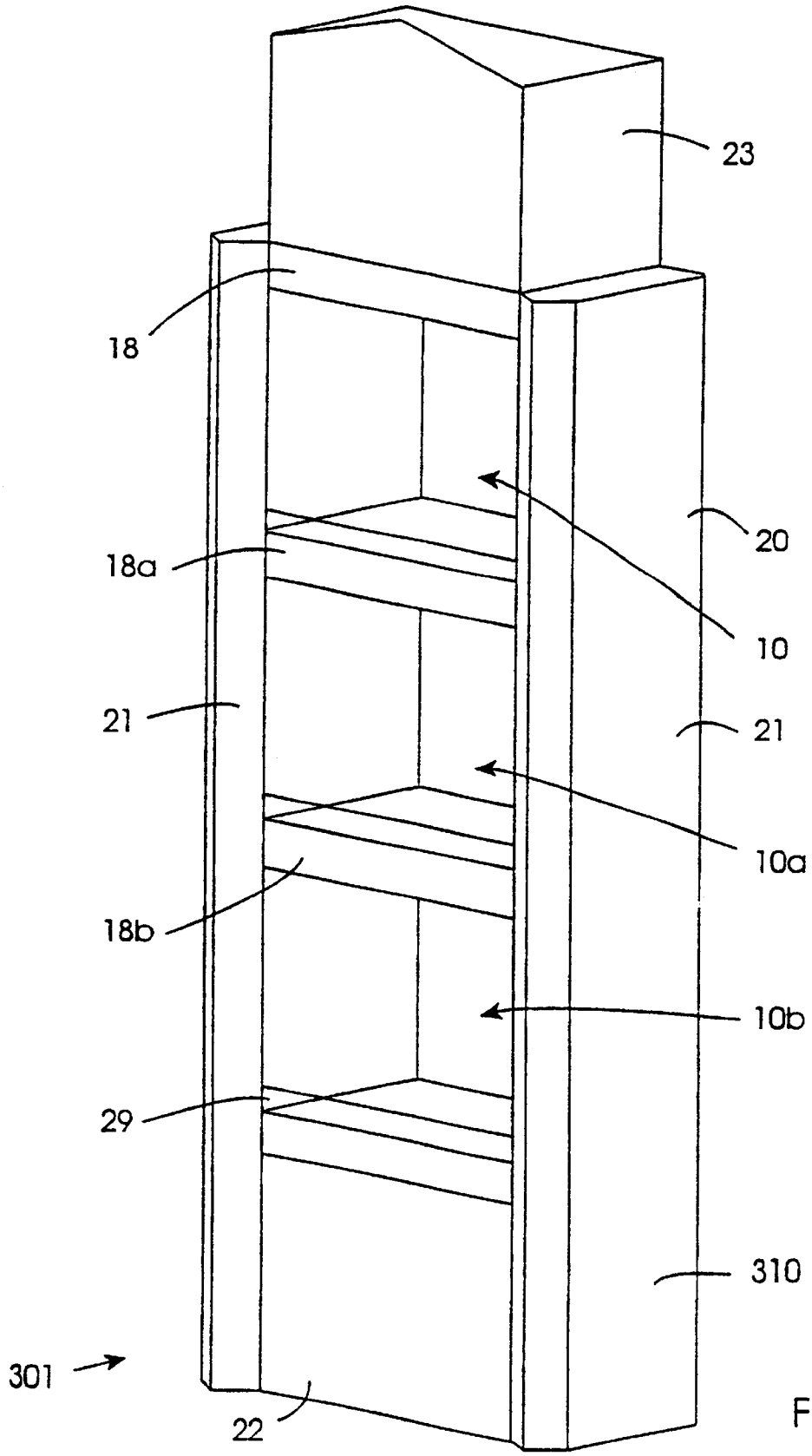
FIG. 5 is a perspective view of a third embodiment of a display unit according to the invention.

With particular reference to FIG. 5 of the drawings, there is shown a third embodiment of a display unit according to the invention, in the form of a display cabinet 301. The display cabinet 301 effectively comprises three display units 10, 10*a*, 10*b*. The units 10*a* and 10*b* are similar in construction to the unit 10. Thus, the cabinet 301 comprises three separate units 10, 10*a*, 10*b*, one on top of the other and housed in a support frame 310 which includes a cabinet base 22 (for elevating the units 10, 10*a* and 10*b* above the ground for optimum display purposes) and a header unit 23 which can carry advertising material pertaining to the product or products on display. Each unit 10, 10*a*, 10*b* is serviced by a respective solid coolant housing 100 (or 200) located behind respective flaps 18, 18*a* and 18*b*.

Alternatively, the display cabinet 301 may be constructed such that the side walls 20, 21 and rear wall 24 are common to all three units 10, and the roof 22 of one unit is common with the base 23 of the one above it, with appropriate openings for three housings 100 (or 200) and three compartments 28 for products.

Figure 6:
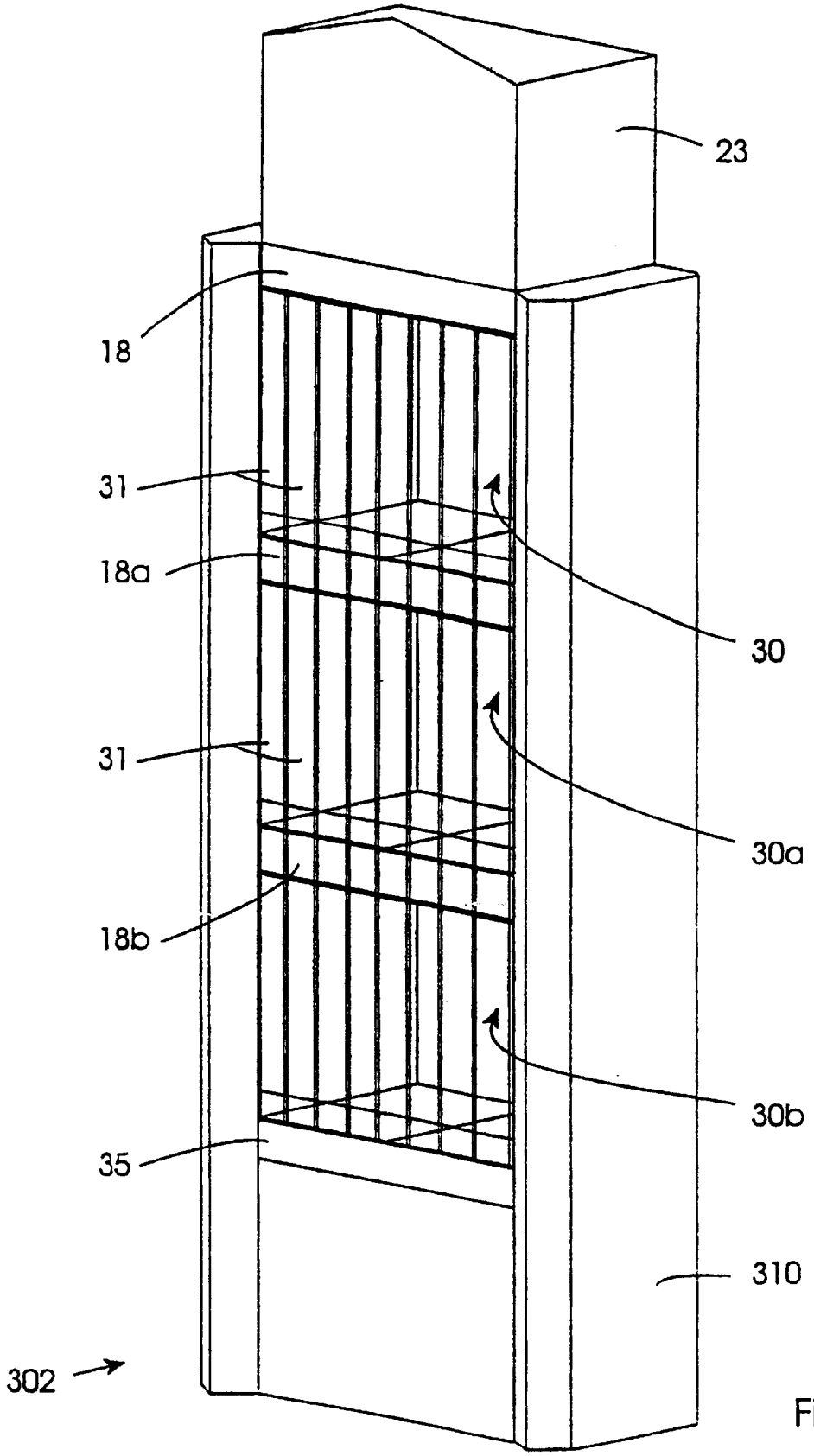
FIG. 6 is a perspective view of a fourth embodiment of a display unit according to the invention.

With particular reference to FIG. 6 of the drawings, there is shown a fourth embodiment of a display unit 302 according to the invention which enjoys all the features of the cabinet 301 (and the variations thereof) and having the plastics strips 31 as shown and described with respect to the unit 30 (or 30*a*, 30*b*). However, in order to provide better insulation for the lowermost opening 28, a thermally insulated base 35 is provided.

Figure 7:
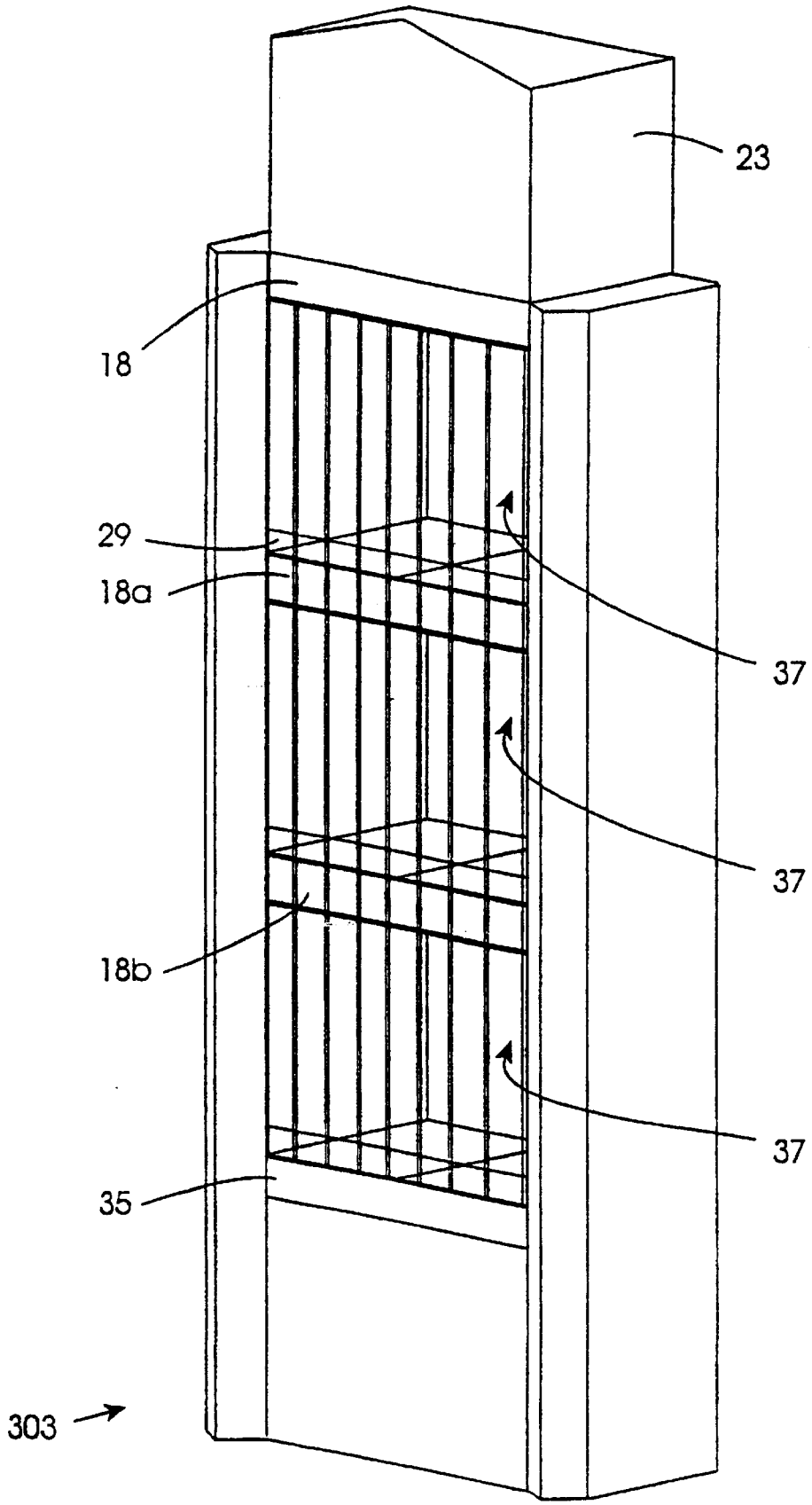
FIG. 7 is a perspective view of a fifth embodiment of a display unit according to the invention.
Figure 20:
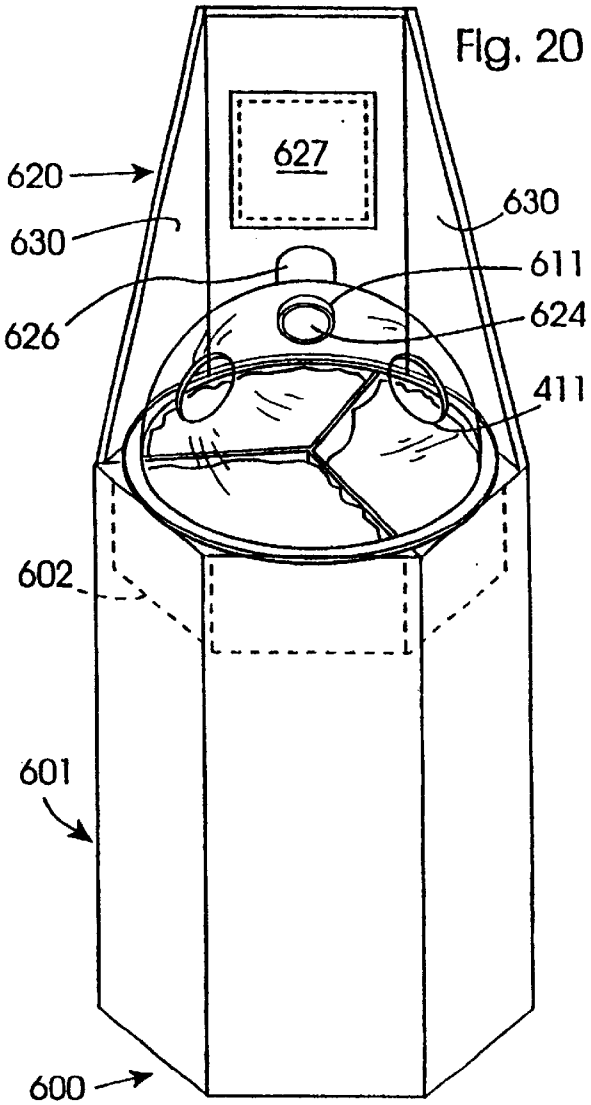
FIG. 20 is a perspective view of an eighth embodiment of a display unit according to the invention.
Figure 14:
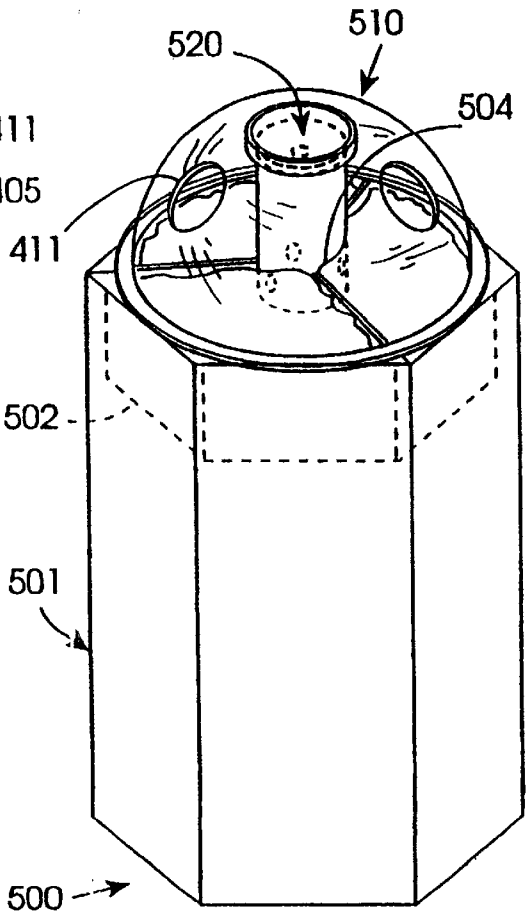
FIG. 14 is a perspective view of a seventh embodiment of a display unit according to the invention.
Figure 8:
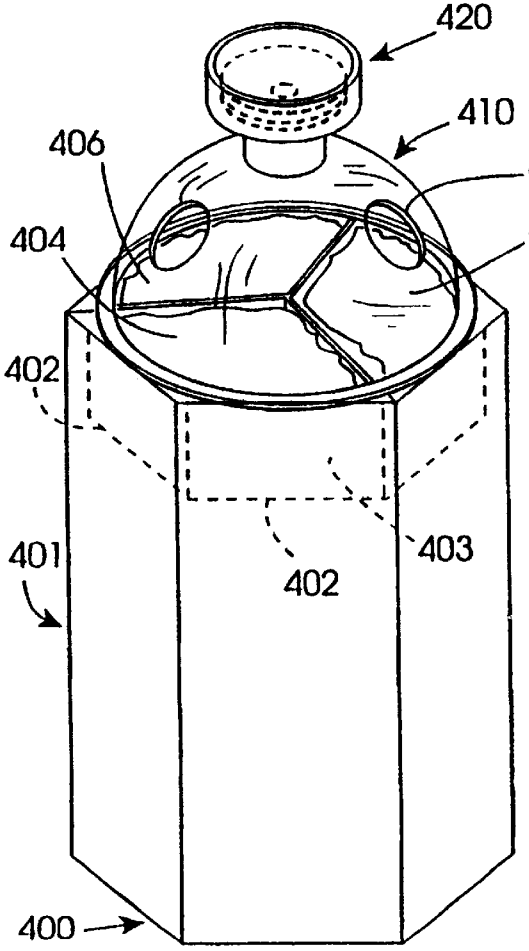
FIG. 8 is a perspective view of a sixth embodiment of a display unit according to the invention.

With particular reference to FIG. 7 of the drawings, there is shown a fifth embodiment of a display unit 303 according to the invention which enjoys all the features of the cabinet 301 (and the variations thereof) and the base 35 of the cabinet 302 but with strips of plastics material 37 similar to the strips 31 except each strip extends the height of all of the units 10, 10*a*, 10*b* (or 30, 30*a*, 30*b*).

The unit 10 or 30 or the cabinet 301, 302 or 303 is preferably made from a foldable blank (not shown) of semi-rigid material such as cardboard or other paper-based material.

With reference to FIGS. 8–13 of the drawings, there is shown a sixth embodiment of a display unit 400 according to the invention.

The display unit 400 comprises a six-sided base unit 401 made from card, cardboard or fluted plastic e.g. Corriplast (trade name) which is approximately 1500 mm in height.

The base unit 401 need not necessarily be six-sided; it may have a greater or less number of sides or be circular. Into the open mouth of the base unit 401 is placed a tray 402 having substantially the same external shape as that of the base unit 401 so as to fit snugly therein. The tray 401 has a base 402 and side walls 403. The internal volume of the tray 402 may comprise a single compartment or, as is the case in FIGS. 8–13, may be compartmentalised into three subunits 404, 405, 406.

An acrylic dome 410 serves as a cover for the tray 401, the dome and tray together forming a container for consumer products placed in the tray, as will be described. The dome 410 has a plurality (preferably three) apertures 411 which provide for access to the contents of the tray 401 when the dome 410 is in place. The dome 410 has an insulated dry ice housing 420 which, in the case of FIGS. 8–13 is circular in plan view. The housing 420, however, may be of any desired shape or configuration.

Figure 13:
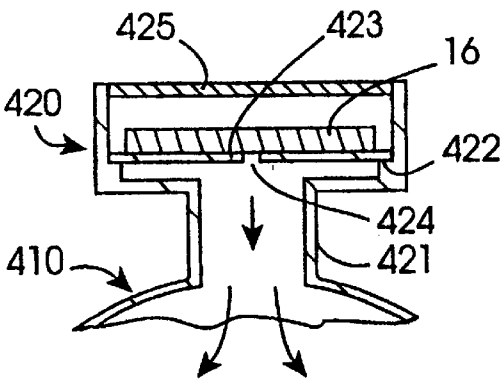
FIG. 13 is a cutaway and detailed view of part of the unit of FIG. 8 of the drawings.
Figure 17:
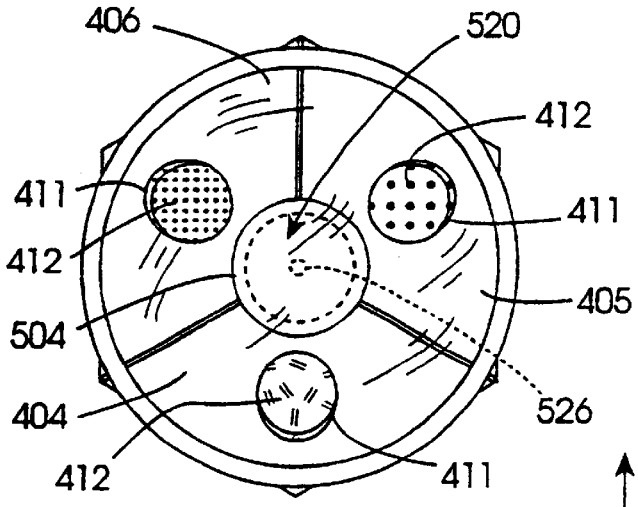
FIG. 17 is a plan view of the unit of FIG. 14 of the drawings.
Figure 15:
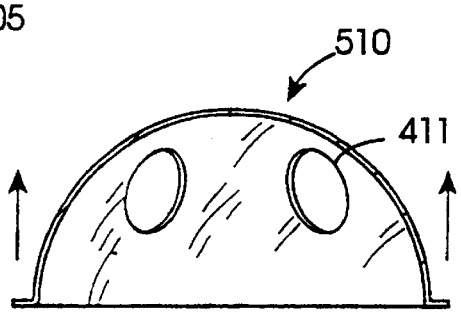
FIG. 15 is a front elevation of the unit of FIG. 14 of the drawings.
Figure 15:
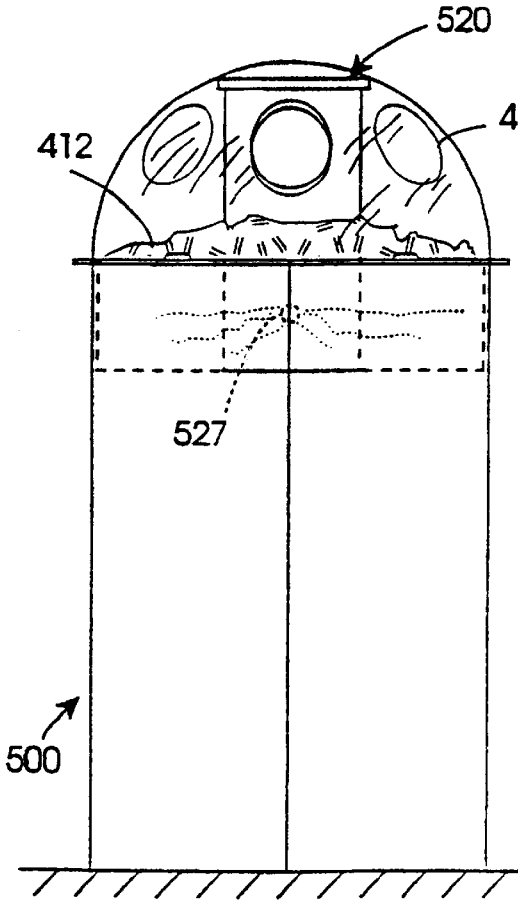
Figure 16:
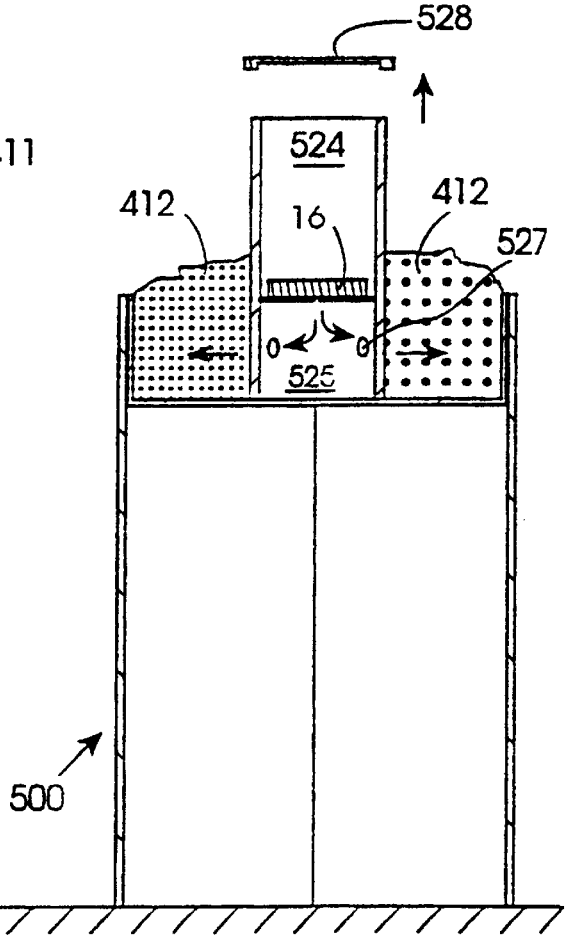
FIG. 16 is a cutaway view of the unit of FIG. 14 of the drawings showing the cover detached therefrom.
Figure 24:
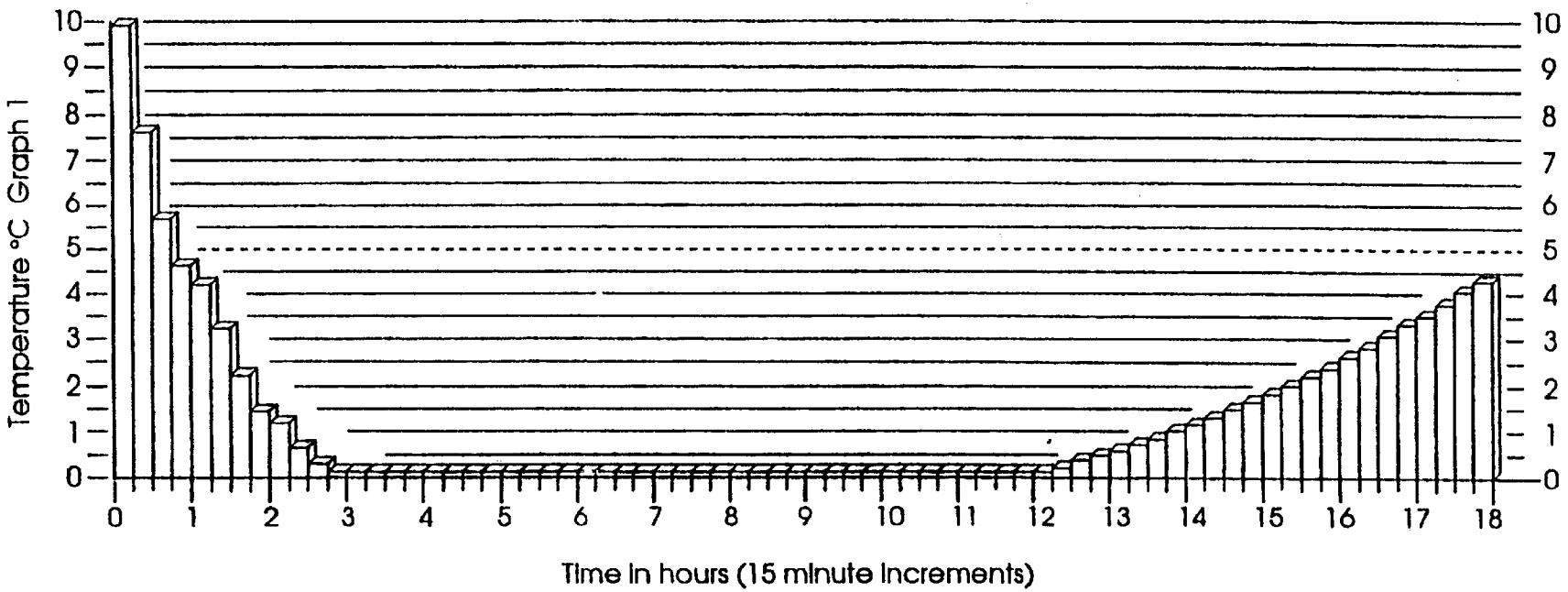

With particular reference to FIG. 13, it will be observed that the housing 420 is integral with the dome 410, being joined thereto by an integral tubular element 421 providing a passageway for cold gas (i.e. air and/or carbon dioxide) to flow downwardly from the housing 420 to the interior of the dome 410.

As will be observed from FIG. 13 of the drawings, the housing 420 has an internal circumferentially disposed ledge 422. Resting on the ledge is a floor 423, forming the base of the housing 420, having a single circular aperture 424 located substantially centrally of the floor 423. The aperture has a diameter $\phi$ of between 5 mm and 40 mm with a preferred diameter $\phi$ of approximately between 10 mm and 15 mm. A lid 425 is provided for the housing 420.

As an alternative, the dome 410 may have an opening (not shown) at the apex thereof. A housing 430 (FIG. 12) is provided which enjoys all the features as described with respect to the housing 420 in addition to an integral tubular element 431 which can mate with the opening in the apex of the dome 410.

In use, the dome 410 is removed from the tray 401 and the tray 401 stacked with merchandise such as chocolate bars, sweets, etc. generally indicated as 412. If the tray 401 is compartmentalised, as is the case shown here, three types of product may be placed therein. The dome 410 is replaced.

Into the compartment 420 is placed one or more packs 16 of dry ice. The packs 16 are preferably circular in cross-section. Because the housing 420 is integral with the dome 410, some users may find it disadvantageous to place (or replace) the packs 16 because of the need for relatively thick insulating gloves for use by the person responsible for ensuring that there is sufficient dry ice present. This is avoided by using the housing 430, which is removable together with the tubular element 431 as a unit from the dome and which can be supplied ready packed with dry ice packs 16. Thus, for the purposes of recharging the cabinet 400 with a fresh change of ice packs 16, the housing 430 is removed from the dome 410 and replaced with another similar housing 430 having a fresh charge of packs 16. As will be observed in FIG. 13 of the drawings, as the ice sublimes, cold air and carbon dioxide exits the aperture 421, travels down the tubular element 421 and under the dome 410 where it bathes the produce 412 in a cold environment. Customer access to the produce 412 is via the apertures 411.

It will be appreciated that the housing 420 or 430 is in principle the same as the houisng 200 of FIG. 2.

With reference to FIGS. 14–19 of the drawings, there is shown a seventh embodiment of a display unit 500 according to the invention. The unit 500 has a base unit 501 which has the same features as the base unit 401. A tray 502 is provided which also enjoys the same features as the tray 402 except that in the case of a compartmentalised tray 502, the walls 503 terminate in a centrally disposed circularly shaped recess 504.

A dome 510 is also provided which has the same features as the dome 410 except that the dome 510 does not have a tubular element similar to the element 421 nor does it have an opening disposed in the apex thereof.

A cooling device 520 is provided which comprises a tubular body 521 having a circumferentially disposed ledge 522. A plate-like element 523 rests on the ledge 522 to divide the internal volume of the element 521 into an upper dry ice housing 524, of which the element 523 forms the base, and a lower passageway 525.

The element 523 has a single centrally disposed circular aperture 526 having a diameter $\phi$ of between 5 mm and 40 mm, preferably between 10 mm and 15 mm. The passageway 525 is provided with a plurality of apertures 527 each having a diameter of approximately 15 mm in the side wall thereof. The device 520 is provided with a cover 528.

It will be seen that the construction of the dry ice housing 524 is in principle the same as that of the device 200, and like the latter houses in use one or more packs of dry ice 16 having a circular cross-section.

The display unit 500 functions in a manner similar to that of the display unit 400 except as follows. With the dome 510 removed, the cooling device 520 having one or more packs 16 of dry ice therein is placed in the tray 502, the lower edge of the passageway 525 engaging the recess 504. The apertures 527 are disposed such that, as will be observed in FIGS. 15 and 16 of the drawings, they are within the space bounded by the tray 502 and thus, the cold air and $CO_2$ gas can permeate the merchandise 412 therein.

With particular reference to FIGS. 20–24 of the drawings, there is shown an eighth embodiment of a display unit 600 according to the invention. The unit 600 has a base unit 601 which has the same features as the base unit 401. A tray 602 is provided which also enjoys the same features as the tray 402.

Projecting upwardly from the rear of the base unit 601 and preferably integral therewith is a cooling device 620. In order to provide support for the cooler device 620, laterally disposed wing elements 630 are provided.

The cooling device 620 has two major walls, viz a rearwardly disposed wall 621 and a forwardly disposed wall 622. The walls 621, 622 are in substantially parallel spaced apart relationship and together with narrow sidewalls (not shown) define a compartment generally shown as 623.

Figure 24:
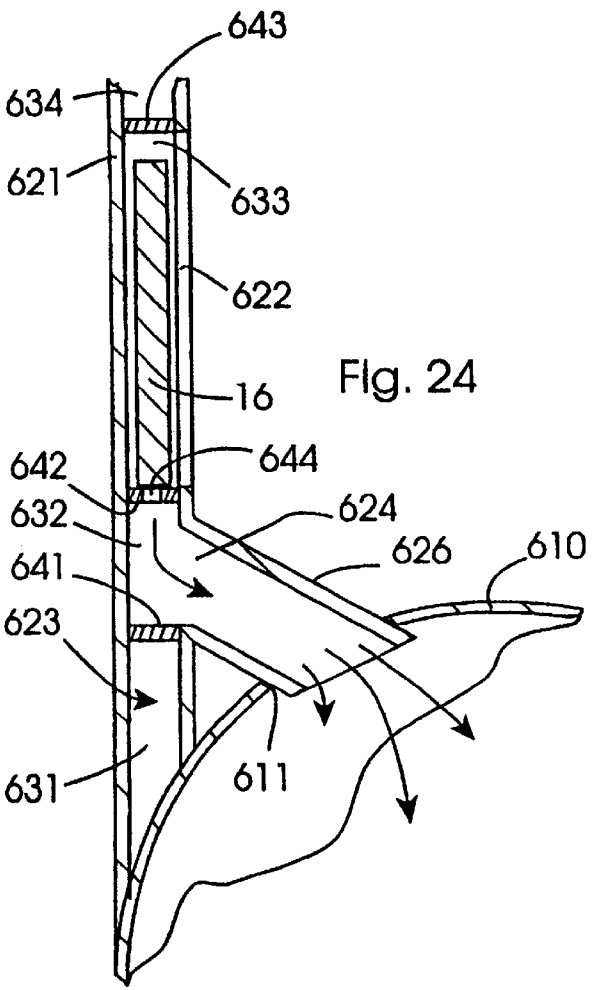
FIG. 24 is a detailed and cutaway view of part of the unit of FIG. 20 of the drawings.
Figure 18:
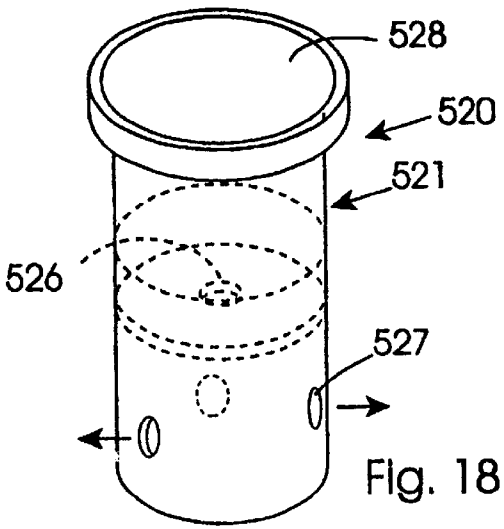
FIG. 18 is a perspective and detailed view of part of the unit of FIG. 14 of the drawings.
Figure 19:
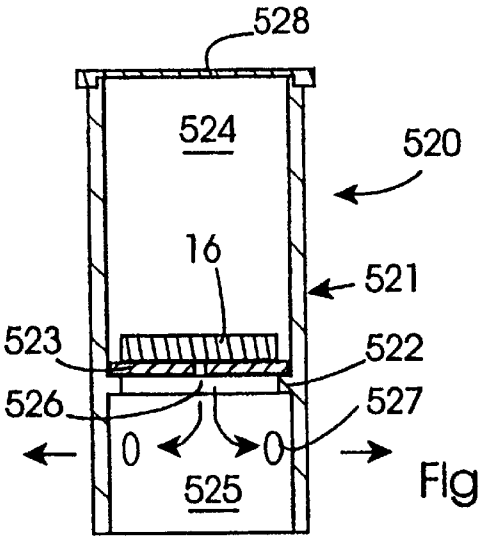
FIG. 19 is a cutaway and detailed view of part of the unit of FIG. 14 of the drawings.
Figure 12:
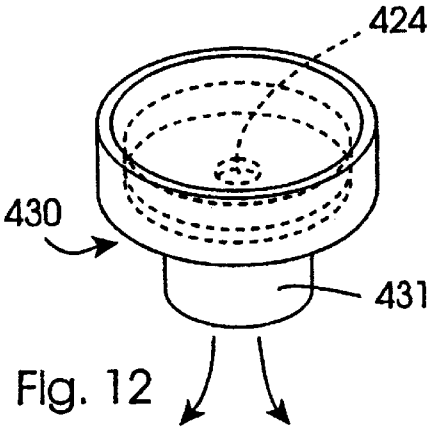
FIG. 12 is a perspective and detailed view of part of the unit of FIG. 8 of the drawings.

Reference should be made to FIG. 22 or FIG. 24 of the drawings. Whereas the wall 621 is without apertures, the wall 622 has two apertures 624, 625. The aperture 624 is circular in cross-section and is located below the aperture 625. Preferably integral with the aperture 624, there is provided a tubular member 626 which projects away from and downwardly relative to the wall 622. The aperture 625 is substantially rectangular in plan view and is closed by a door or cover 627 which, in the present embodiment, is hinged along the lower edge of the cover 627 relative to the wall 622.

The compartment 623 is subcompartmentalised into four sub-compartments 631, 632, 633 and 634. Thus, the sub-compartment 631 is bounded by the walls 621, 622, the dome 610 and a first horizontally disposed floor 641. The sub-compartment 632 is bounded by the wall 621, the floor 641 and a floor 642. The sub-compartment 632 is in fluid communication with the tubular member 626. The subcompartment 633 is bounded by the wall 621, the cover 627, the floor 642 and a floor 643. The sub-compartment 644 is bounded by the walls 621, 622, the floor 643 and the top 645 of the cooler device 620. The floor 641 is located such that the base of the sub-compartment 632 and the tubular member 626 provide a smooth passageway for a gas flowing from the sub-compartment 632 into the tubular member 626.

The subcompartment 633 constitutes a housing for dry ice 16, the floor 642 constituting the base of the housing and being equivalent to the floor 115 of the housing 200. Like the floor 115, it is provided with a centrally disposed circular aperture 644 the diameter $\phi$ of which is between 5 mm and 40 mm, preferably between 10 mm and 15 mm.

The floor 643 is located so as to provide a large enough sub-compartment 633 for having one or more packs 16 of dry ice.

A dome 610 is provided which is substantially similar to the dome 410 except that the opening in the apex thereof is not provided. Instead, an opening 611 is provided which, when the dome 610 is in situ, mates with the tubular member 626 thereby enabling cold air and $CO_2$ gas to flow into the space bounded by the dome 610 thereby providing a cold environment for the merchandise 412.

It will be appreciated that the display units 400, 500 and 600 function in a similar manner to each other and to the display unit 30.

Figure 26:
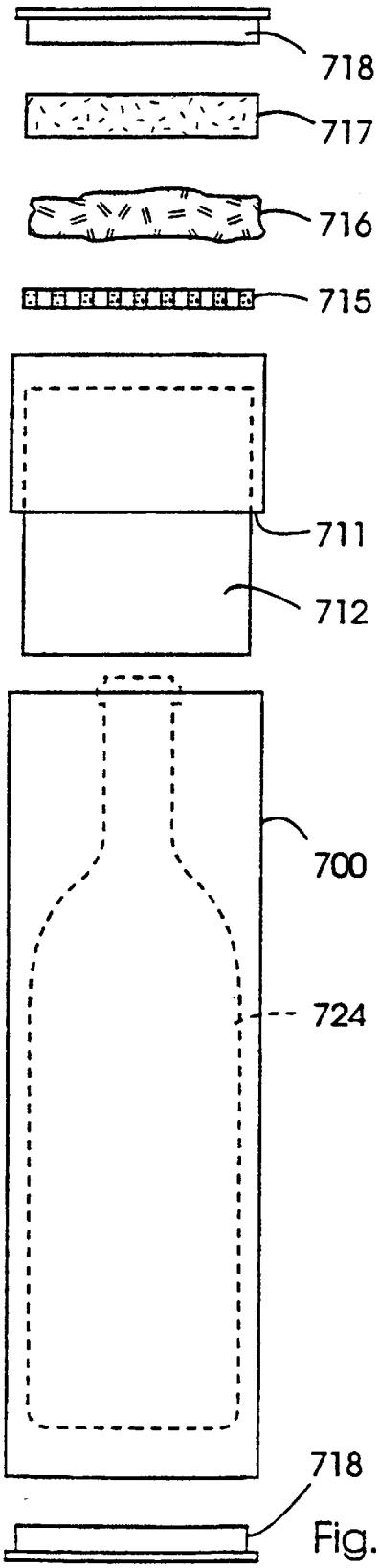
FIG. 26 is an exploded view of the embodiment of FIG. 25.
Figure 25:
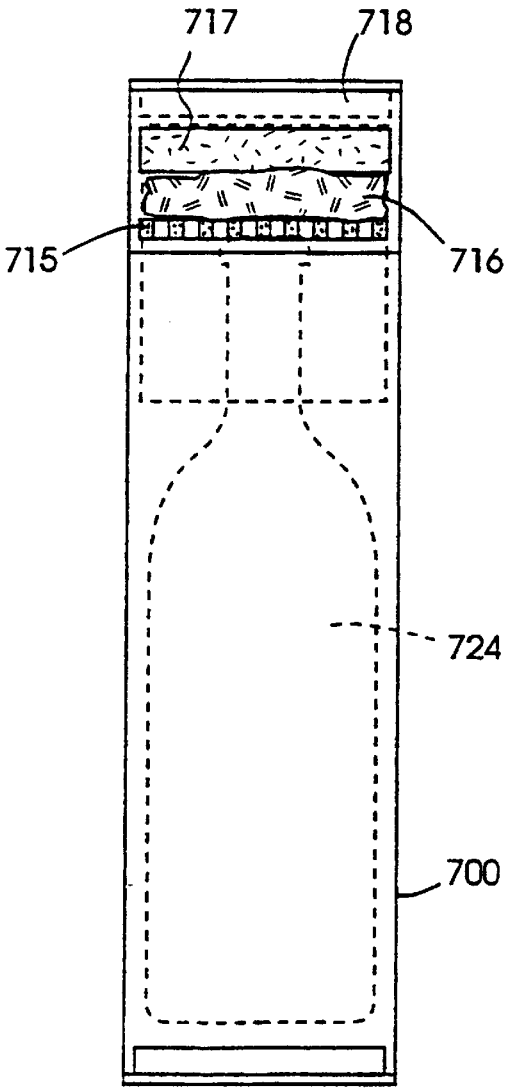
FIG. 25 is a cross-sectional view of a ninth embodiment of the invention.

In a ninth embodiment of the invention, FIGS. 25 and 26, the apparatus comprises a cylindrical container 700 for keeping cool a product such as a bottle of wine 724. A removable lid 712 for the container comprises a hollow cylindrical body on which an external step 711 is formed. The step 711 prevents over-insertion of the lid 712 into the container 700.

An internal step (not shown) is formed within the lid 712 and a cylindrical open mesh grid 715 is located within the lid resting on the step. A 250 g bag 716 of dry ice pellets is located over the grill 715, and this is in turn is covered by a polystyrene thermally insulating disk 717. The contents of the lid 712 are held in place with a removable push-fit cap 718, while the bottom of the container is also closed with a similar push-fit cap 718'.

It will be appreciated that the elements 715, 717 and 718, together with the sidewalls of the lid 712, form a solid coolant housing in principle the same as the housing 100 described in relation to FIG. 1. Of course, instead of the grill 715, one could instead use a plate having a single circular central aperture as described for the housing 200.

Although certain of the above embodiments have described a solid coolant housing having only a single circular aperture in the base of the housing, such aperture preferably having a diameter of between 5 mm and 50 mm, and most preferably between 10 mm and 15 mm, it will be appreciated that more than one aperture may be provided in the base of the housing, in which case the cumulative area of the apertures is preferably equivalent to the area of a circle having a diameter of between 5 mm and 50 mm, and most preferably between 10 mm and 15 mm.

Figure 27:
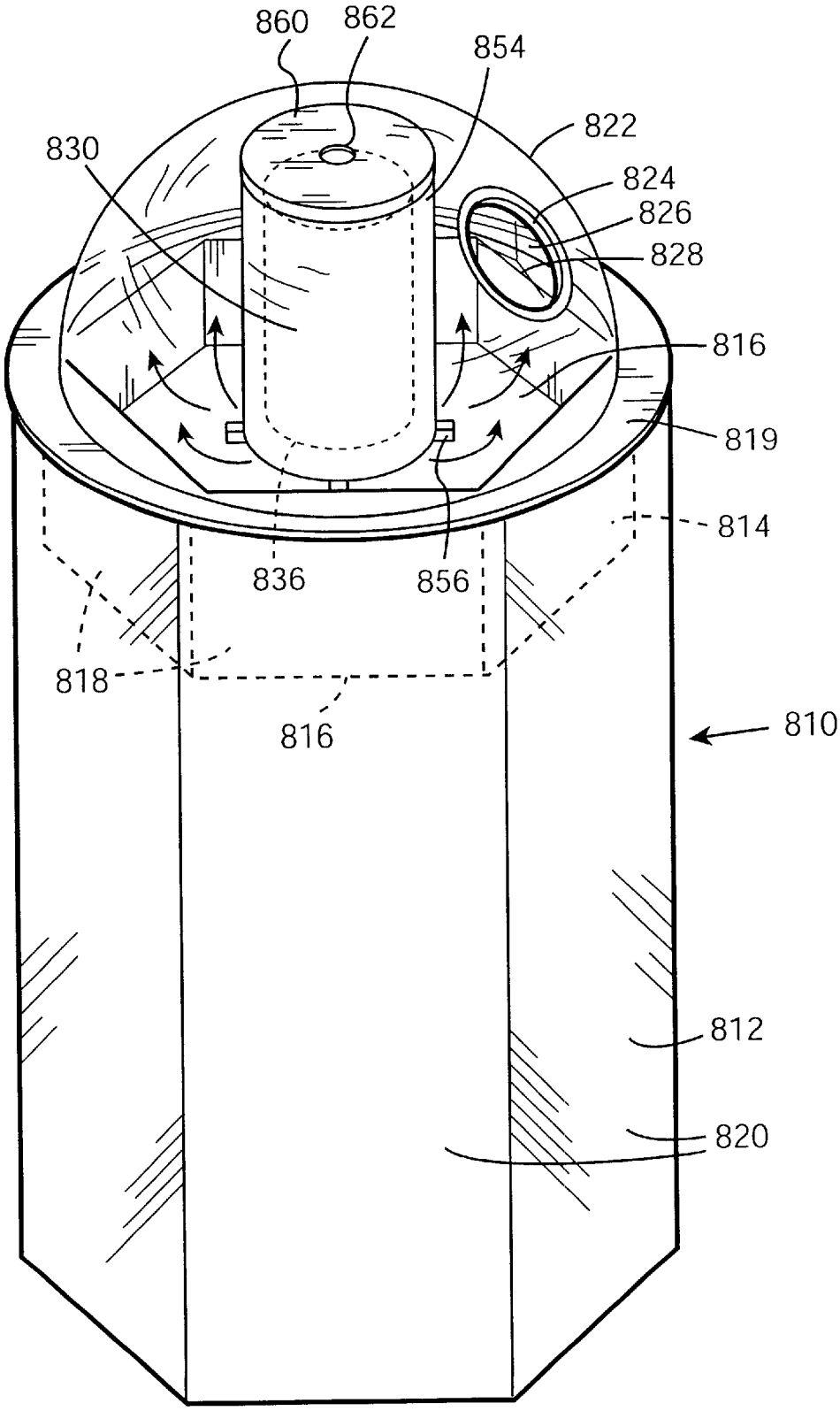
FIG. 27 is a perspective view of a display apparatus according to a tenth embodiment of the invention.

Referring now to FIG. 27 of the drawings, a display unit 810 according to a tenth embodiment of the invention comprises a six-sided base unit 812 made from card, cardboard or fluted plastic, e.g. Corriplast (trade name), which is approximately 1500 mm in height. The base unit 812 need not necessarily be six-sided; it may have a greater or less number of sides or be circular.

Into the open mouth of the base unit 812 is placed a tray 814 of substantially the same external shape as that of the base unit 812. The tray 814 is moulded from rigid plastics material and has a floor 816, side walls 818 and an outturned lip 819 which rests upon the upper edge of the base unit 812 to support the tray therein. The sidewalls 818 are spaced inwardly of the walls 820 of the base unit 812 and the gap between them is filled with panels of a thermally insulating foam material (not shown) such as polystyrene foam, and a panel of the same foam material (also not shown) is also disposed immediately under the floor 816 of the tray.

Figure 28:
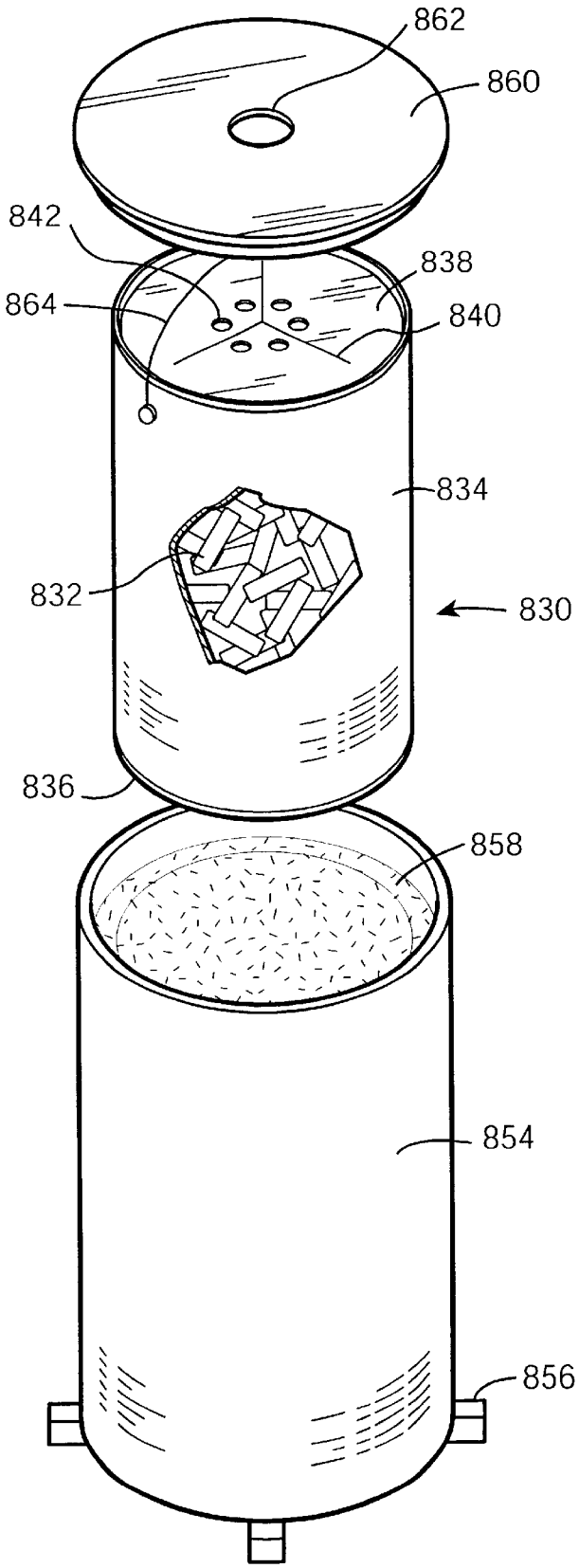
FIG. 28 is an exploded view of a cooling unit forming part of the apparatus of FIG. 27.

A removable transparent acrylic dome 822 serves as a cover for the tray 814, the dome and tray together forming a container for consumer products placed in the tray. The dome 822 has an aperture 824 which allows access to the contents of the tray 814 when the dome 822 is in place. The aperture 824 is closed by a membrane 826 of clear flexible plastics material, the sheet 826 being slit at 828 to allow a hand to be inserted into the container to remove a product. The container formed by the dome and tray contains a cooling unit in the form of a cylindrical housing 830 for containing pellets 832 (FIGS. 28, 29 and 30) of dry ice.

Referring now in particular to FIGS. 28 to 32, the housing 830 comprises a cylindrical sidewall 834 of rigid plastics material, a base 836 and a top closure in the form of a clear flexible plastics membrane 838. Like the membrane 826, the membrane 838 has slits 840 to allow pellets 832 of dry ice to be loaded into the housing 830, the membrane also having ventilation holes 842.

The base 836 comprises two substantially parallel circular plates 844, 846 having substantially the same diameter and which are disposed immediately adjacent and in register with one another. The plate 844 is fixed across the lower end of the sidewall 834, while the plate 846 is rotatably mounted coaxially to the plate 844 by studs 848. A tab 850 at the periphery of the plate 846 allows manual rotation of that plate. Each plate has a plurality of apertures 852. The apertures 852 are so arranged in each plate such that for different angular positions of the plate 846 relative to the plate 844 there is a different degree of overlap of the apertures in the two plates. This is shown for four angular positions of the plate 846 in FIG. 32, where the hatched lines indicate apertures in the plate 846 which are not in register with apertures in the plate 844, and are therefore blocked. As will be described, this allows the rate of sublimation of dry ice in the housing 830 to be varied.

Figure 29:
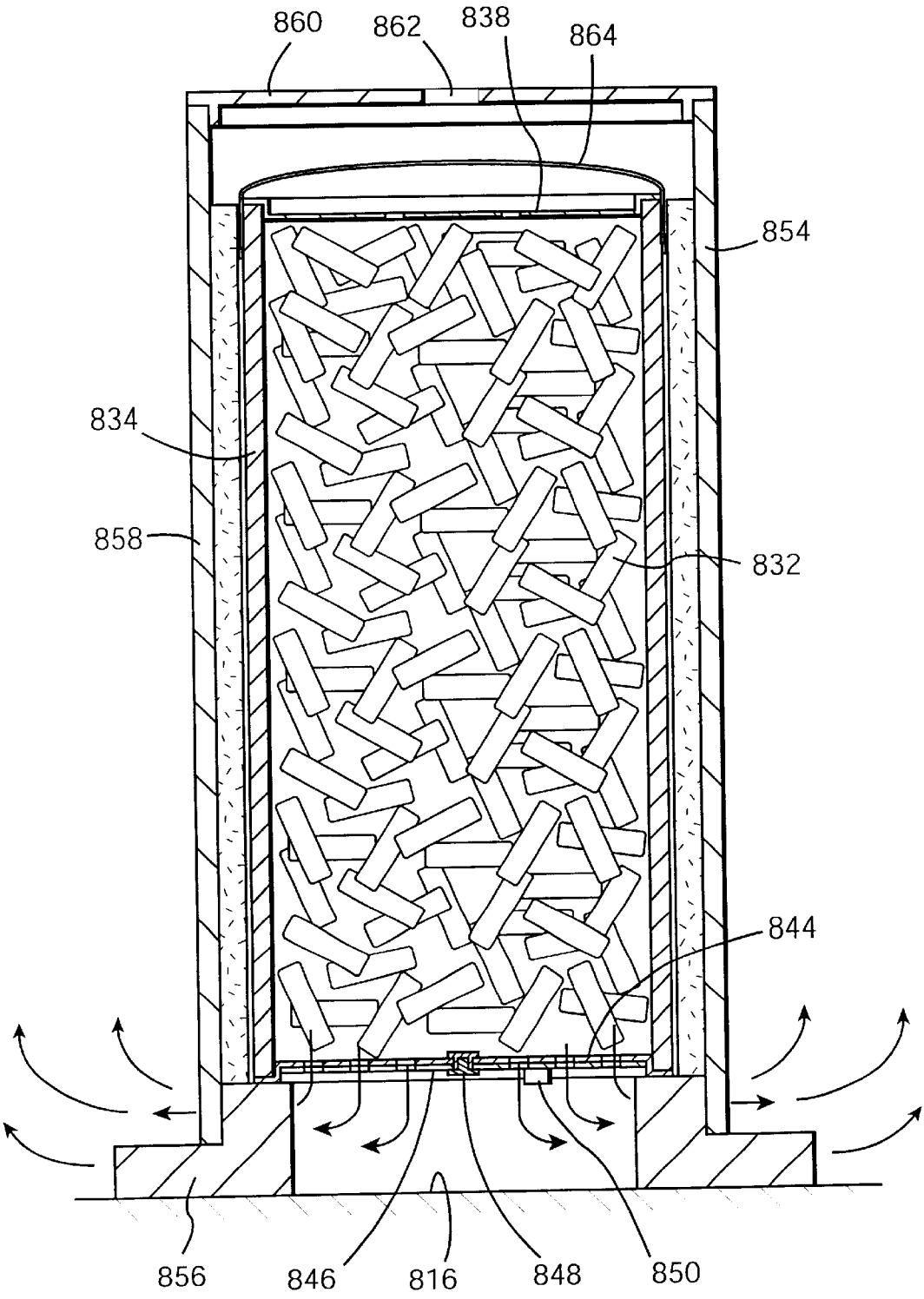
FIG. 29 is a cross-section through the cooling unit of FIG. 28.
Figure 30:
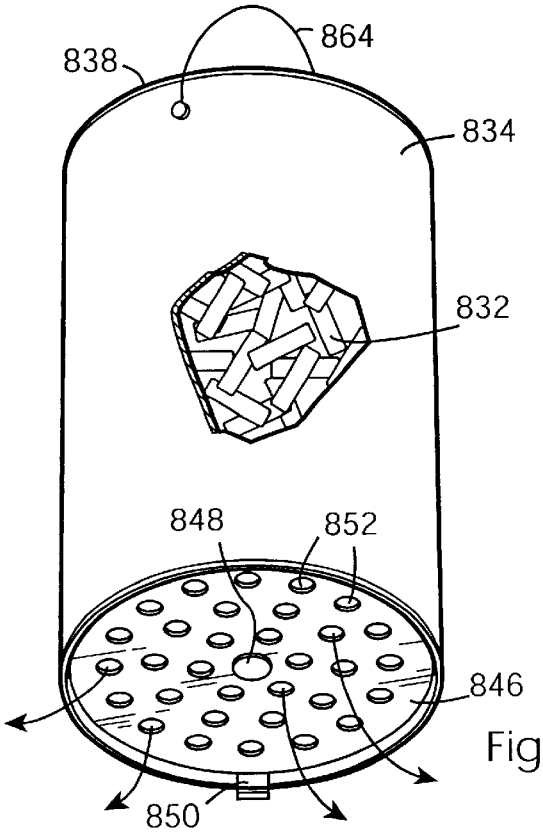
FIG. 30 is an underneath perspective view of the cooling unit of FIG. 28.
Figure 31:
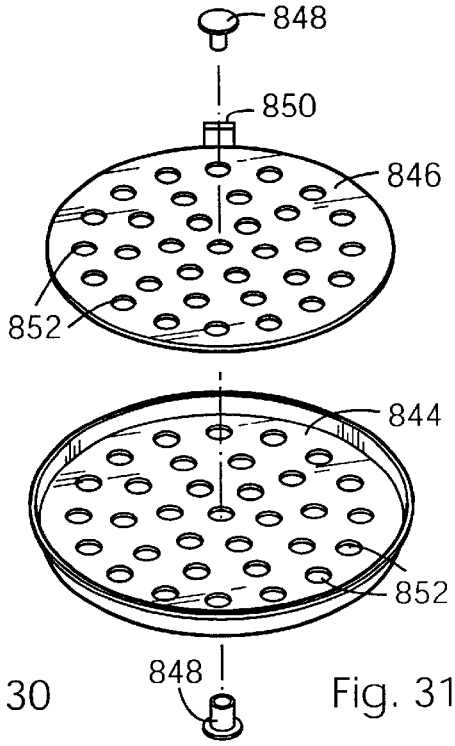
FIG. 31 is an exploded view of the two apertured plates forming the base of the cooling unit of FIG. 28.
Figure 32:
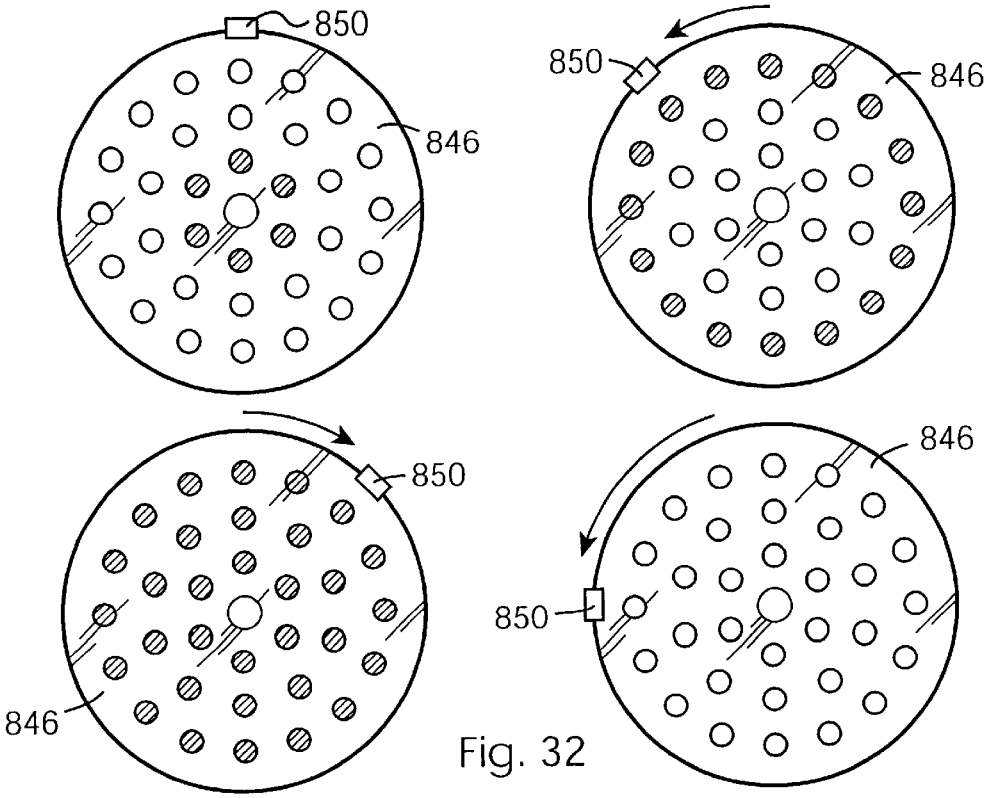
FIG. 32 shows the two plates of FIG. 31 in various relative orientations.
Figure 34:
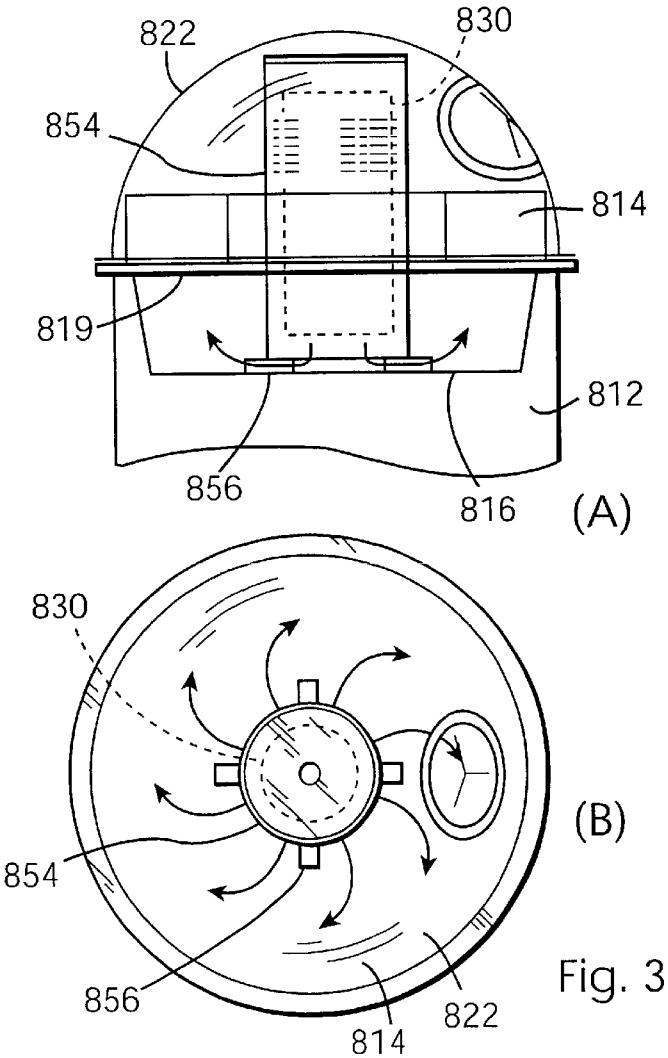
FIGS. 34A and 34B are side and plan views respectively showing the path of cold gas emerging from the base of the cooling unit of FIG. 28.

An open-ended cylindrical tube 854 of rigid plastics material is mounted upstanding in the centre of the tray 814, the lower end of the tube 854 resting on four L-shaped feet 856, as seen in FIG. 29, so that the lower end of the tube is spaced from the floor 816 of the tray. The tube 854 closely surrounds an open-ended cylindrical sleeve 858 of thermally insulating polystyrene foam, the lower end of the sleeve 858 also resting on the feet 856 so that the lower end of the sleeve is also spaced from the floor 816. The axial length of the sleeve 858 is substantially the same as that of the sidewall 834, while the axial length of the tube 854 is greater than that of the sleeve 858 and extends upwardly beyond the top end of the sleeve. The top end of the tube 854 has a removable lid 860 with a ventilation hole 862.

The external diameter of the sidewall 834 of the housing 830 is substantially the same as the interior diameter of the sleeve 858, so that with the lid 860 temporarily removed the housing 830 can be inserted into the sleeve from the top and is a snug fit therein. As seen in FIG. 29, when so inserted the housing 830 also comes to rest on the feet 856, so its base 836 is also spaced from the floor 816 of the tray 814.

Figure 33:
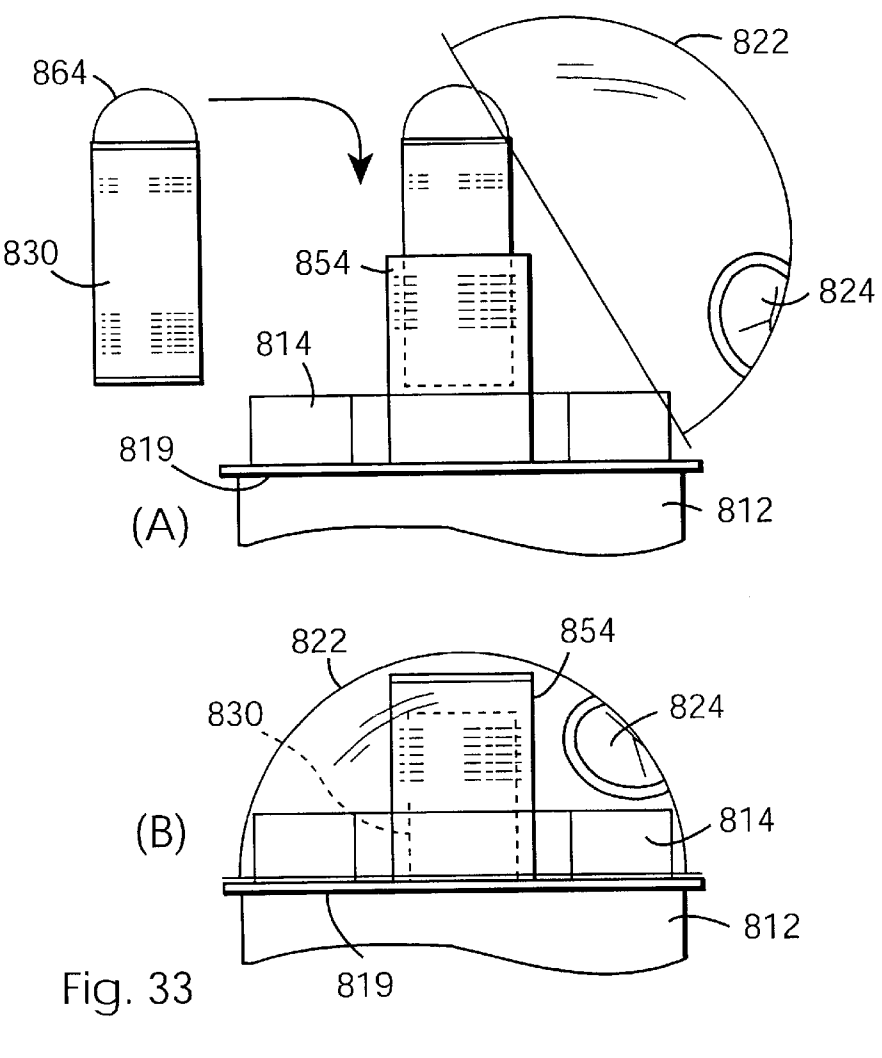
FIGS. 33A and 33B illustrate the cooling unit of FIG. 28 being placed in the cooling apparatus.

In use of the apparatus, FIG. 33A, the dome 822 is removed from the tray 814 and product to be cooled, such as cans of beer (not shown), are placed in the tray 814 surrounding the tube 854. The housing 830 is loaded with dry ice pellets 832 and is lowered by a handle 864 into the sleeve 858 until it comes to rest on the feet 856. Then the lid 860 is replaced on the tube 854 and the dome 822 replaced, FIG. 33B.

As shown by the arrows in FIGS. 29, 30, 34A and 34B, cold carbon dioxide gas from the subliming dry ice in the housing 830 flows down through the coincident apertures 852 in the plates 844, 846 and then outwardly to form a blanket around the products in the tray. It will be understood that the rate of sublimation of the dry ice can be controlled by adjusting the angular position of the plate 844, so that more or less apertures 852 are coincident in the two plates. The desired setting will depend both on the ambient temperature and the desired temperature of the product in the tray 814.

It will be understood that the exterior surface of the tube 854 and/or the exterior surface of the base unit 812 can bear suitable advertising material.

The invention, particularly with respect to FIGS. 8–34 of the drawings provide examples of convenient, inexpensive and easy to use display units which enable merchandise to be presented under favourable merchandising conditions but also under temperature conditions which are particularly suited to the product without the need for an electrical supply.

The invention is not limited to the embodiments described herein which may be modified or varied without departing from the scope of the invention.

What is claimed is:

1. A display apparatus comprising:

a container having a floor upon which at least one consumer product may be placed;

a cover for said container having an aperture to permit consumer access to said at least one consumer product; and a solid coolant housing having a base with at least one aperture to allow cold gas to flow from said housing, said housing being supported in said container with a space between the base of said housing and the floor of said container, the display apparatus further comprising means for varying the area of said at least one aperture in the base of said housing.

2. A display apparatus as claimed in claim 1, wherein the container includes a tray which is covered by the cover.

3. A display apparatus as claimed in claim 2, wherein the cover is in the form of a dome.

4. A display apparatus as claimed in claim 2, wherein the tray is supported at the top of a base unit.

5. A display apparatus as claimed in claim 1, wherein the base of said housing comprises two substantially parallel plates disposed immediately adjacent and in register with one another, each plate having a plurality of apertures, and wherein one plate is rotatable relative to the other plate such that for different angular positions of the said one plate there is a different degree of overlap of the apertures in the two plates thereby to vary the rate of sublimation of solid coolant in the housing.

6. A display apparatus as claimed in claim 1, wherein the coolant housing is removably accommodated in a sleeve of insulating material surrounded by an open-ended tube, the sleeve and tube being spaced from the floor of the container.

7. A display apparatus comprising:

a container having a floor upon which a consumer product may be placed;

a cover for said container having an aperture to permit consumer access to the product; and a solid coolant housing having a base with at least one aperture to allow cold gas to flow from said housing, said housing being supported in said container with a space between the base of said housing and the floor of said container, wherein said housing has a top closure comprising a flexible membrane with at least one aperture for introducing solid coolant pellets into said housing.

8. The display apparatus of claim 7, wherein said top closure comprises at least one ventilation aperture.

* * * * *